United States Patent [19]

Kotos et al.

[11] 3,944,957

[45] Mar. 16, 1976

[54] FLUX-TRANSFER TRIP DEVICE FOR A CIRCUIT BREAKER

[75] Inventors: Peter Kotos, Havertown; Patrick P. Yen, Philadelphia, both of Pa.

[73] Assignee: General Electric Company, Plainville, Conn.

[22] Filed: Dec. 23, 1974

[21] Appl. No.: 535,640

[52] U.S. Cl. ..... 335/174; 335/229; 335/254

[51] Int. Cl.[2] ..... H01H 9/20

[58] Field of Search ..... 335/174, 179, 170, 229, 335/230, 234, 235, 236, 253, 254, 255

[56] References Cited

UNITED STATES PATENTS

| | | | |
|---|---|---|---|
| 3,693,122 | 9/1972 | Willard | 335/174 |
| 3,755,766 | 8/1973 | Read, Jr. | 335/229 |

*Primary Examiner*—Harold Broome
*Attorney, Agent, or Firm*—R. A. Cahill; W. C. Bernkopf; F. L. Neuhauser

[57] ABSTRACT

This trip device comprises a permanent magnet of cobalt-rare earth material and a plunger which is normally held in a withdrawn position by the permanent magnet. A tripping coil surrounds the plunger and, upon energization, develops tripping flux that opposes the holding flux from the permanent magnet, thereby to effect release of the plunger. In a position between the tripping coil and the permanent magnet, flux-diverting structure of highly permeable magnetic material is provided for shunting a portion of the tripping flux through a shunt path bypassing the permanent magnet. This shunt path contains a relatively large non-magnetic gap for limiting the tripping flux through the shunt path sufficiently to cause 30 percent or more of the tripping flux to pass through the permanent magnet in a direction opposite to the direction of the holding flux. When the tripping coil is deenergized, this non-magnetic gap limits the holding flux through the shunt path to 10 percent or less of the total holding flux of the permanent magnet.

5 Claims, 4 Drawing Figures

FLUX-TRANSFER TRIP DEVICE FOR A CIRCUIT BREAKER

BACKGROUND

This invention relates to a trip device for an electric circuit breaker and, more particularly, to a trip device that relies upon a permanent magnet for holding a trip-controlling plunger in a withdrawn position and a tripping coil that, upon energization, develops flux that opposes flux from the permanent magnet, thereby effecting release of the plunger.

References of interest with respect to this invention are the following: U.S. Pat. Nos. 3,671,893—Edgar et al.; 3,675,167—Ellenberger; 3,693,122—Willard; and 3,783,423—Mater et al.

In a typical construction of such a trip device there is a flux diverter located between the permanent magnet and the plunger. The diverter is designed so that most of the flux developed by the tripping coil when energized is forced to follow a path through the diverter so as to protect the permanent magnet from demagnetization by such flux. If the diverter in the typical trip device is to have the desired effectiveness in protecting the permanent magnet, it must present a relatively low reluctance path to flux from the tripping coil. But if such a low reluctance path is present, it is difficult to efficiently utilize the flux developed by the permanent magnet for holding the tripping plunger since a large portion of such flux from the permanent magnet will be shunted through the diverter without contributing to the plunger holding action.

SUMMARY

An object of the invention is to construct the trip device in such a manner that an exceptionally large percentage of the total flux developed by the permanent magnet can be utilized for holding the plunger in its withdrawn position despite the presence of a flux diverter between the permanent magnet and the plunger.

Another object is to effect release of the plunger with an exceptionally small amount of energy.

Another object is to prevent demagnetization of the permanent magnet despite the passage therethrough of a relative large percentage of the flux developed by the tripping coil.

To enable release of the plunger to be effected by a small amount of energy, it is necessary that the holding force from the permanent magnet be relatively low. If the plunger is to be retained in its withdrawn position against the face of a pole piece by this low holding force from the permanent magnet, it is important that no foreign matter be allowed between the plunger and said pole piece face.

Accordingly another object of the invention is to construct the trip device in such a way that foreign matter from outside the trip device cannot find its way into the region between the plunger and the pole piece face.

Another object is to construct the trip device in such a manner that the plunger will have a high resistance to unintentional displacement by vibrations and shocks.

In carrying out the invention in one form, we provide a frame of highly permeable magnetic material comprising a back wall, a front wall, and a pair of spaced side walls extending between said front and back walls. A plunger of highly permeable magnetic material is supported for straight-line movement through a close-fitting hole in the front wall. Within the frame, a permanent magnet of cobalt-rare earth material is provided having a pair of opposed poles, one of which is located adjacent the back wall. A pole piece of highly permeable magnetic material is located between the other pole of the permanent magnet and the plunger and provides a surface against which the plunger is held in a withdrawn position by holding flux from the permanent magnet passing through the interface between the pole piece and the plunger. Also within the frame we provide a tripping coil surrounding a portion of the plunger for developing, upon energization, tripping flux passing through said interface that opposes the holding flux from the permanent magnet passing through the interface, thereby effecting release of the plunger from its withdrawn position upon energization of the tripping coil. Flux-diverting structure of highly permeable magnetic material is located between the tripping coil and the permanent magnet for shunting a portion of said tripping flux through a shunt path that bypasses the permanent magnet and the back wall. This shunt path contains a relatively large non-magnetic gap for limiting the tripping flux through the shunt path sufficiently to cause about 30 percent or more of the tripping flux to pass through the permanent magnet in a direction opposite to the direction of the holding flux. The non-magnetic gap acts when said coil is deenergized to limit the holding flux passing through said shunt path sufficiently to cause about 90 percent or more of the total holding flux developed by the permanent magnet to pass through the aforesaid interface.

DETAILED DESCRIPTION OF PREFERRED EMBODIMENT

Figure 1:
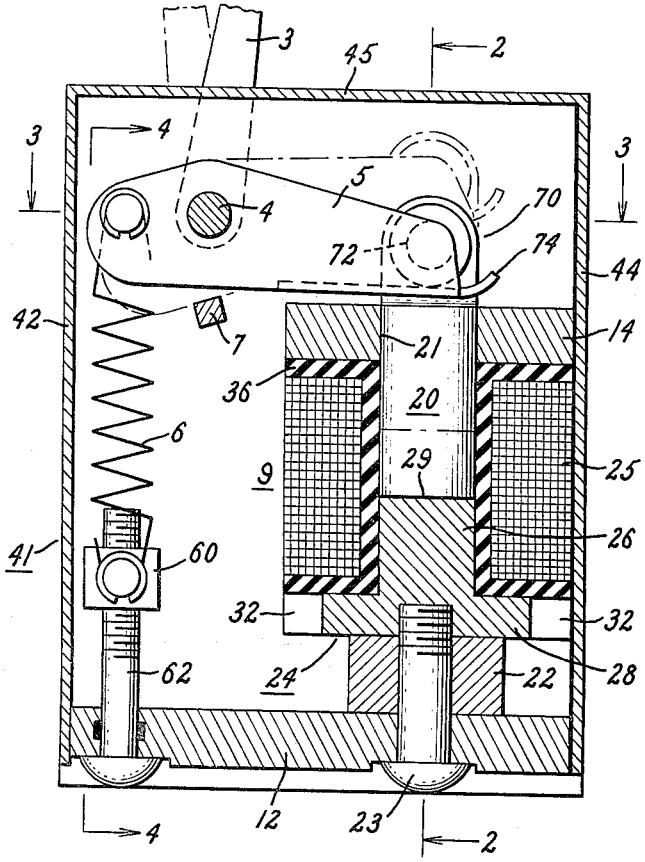
FIG. 1 is a side elevational view, partly in section, showing an electromagnetic trip device embodying one form of the invention.

Referring now to FIG. 1, the illustrated trip device comprises a trip arm 3 that is mounted on and keyed to a rotatable operating shaft 4. Also mounted on and keyed to shaft 4 is an operating lever 5 that is biased in a counterclockwise direction about the axis of shaft 4 by a tensiontype tripping spring 6 located at the left-hand end of the lever. Located at the right-hand end of operating lever 5 is latching means 9 comprising a trip-controlling plunger 20 pivotally coupled to the operating lever and a permanent magnet 22 that normally holds the plunger in the withdrawn position of FIG. 1. When the plunger 20 is released, as will soon be described, the tripping spring 6 is free to drive the operating lever 5 and trip arm 3 through a counterclockwise circuit-breaker tripping stroke. This tripping stroke is terminated when lever 5 encounters a stationary stop 7. A more detailed description of parts 3–6 appears hereinafter.

The latching means 9 comprises a frame 10 of high permeability magnetic material, e.g., iron or steel, comprising a back, or lower, wall 12, a front, or upper, wall 14, and a pair of spaced-apart side walls 16 and 18 extending between said back and front walls. Suitable screws (not shown) of magnetic material are used for clamping the side walls 16 and 18 to opposite sides of front wall 14 and back wall 12.

The previously-mentioned plunger 20 of the latching means is a generally cylindrical member of high permeability magnetic material that is supported for straight-line reciprocal movement through a close-fitting circular hole 21 in the front wall 14 of the frame. Flux from the permanent magnet 22 normally holds plunger 20 in a withdrawn position against the upper face of a stationary pole piece 24 of high permeability magnetic material.

The holding magnet 22 is of a cobalt-rare earth material, preferably cobalt-samarium. Cobalt-rare earth magnets have high coercive force and are very resistant to demagnetization. The particular properties of magnets of this type are more fully described in U.S. Pat. No. 3,671,893—Edgar et al., which is assigned to the assignee of the present invention.

One pole N of the permanent magnet is in close contact with back wall 12 of the frame, and the other pole S is in close contact with the lower surface of pole piece 24. A screw 23 of non-magnetic material extends through aligned holes in the back wall and the permanent magnet and is threaded into a hole in pole piece 24, thereby clamping the permanent magnet against the back wall and the pole piece against the permanent magnet.

Figure 2:
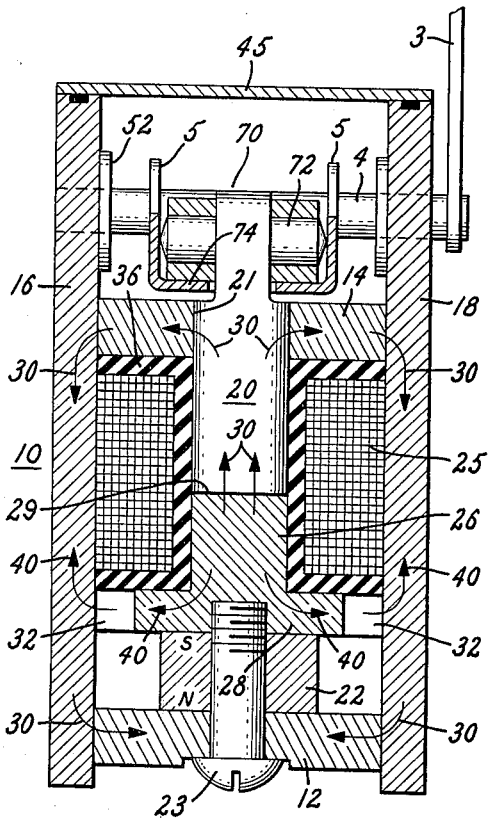
FIG. 2 is a sectional view along the line 2—2 of FIG. 1.

The pole piece 24 is of a T-shape cross-section as viewed in FIGS. 1 and 2. It comprises a central cylindrical body 26 and flux-diverting structure in the form of a flange 28 extending radially outward from the central body portion 26. The flange 28 has a rectangular outer periphery which is spaced from the side walls 16 and 18 by a relatively great distance, thus providing a relatively large non-magnetic gap 32 between the flange and the side walls. The function of this large non-magnetic gap, or air gap, will soon appear more clearly.

Plunger 20 is held against the upper surface of pole piece 24 by holding flux from the permanent magnet passing through the interface 29 between plunger 20 and the cylindrical body 26 of the pole piece. This holding flux follows a path indicated by arrows 30 that includes, in series, the interface 29, the plunger 20, front wall 14, side walls 16 and 18, and back wall 12.

For releasing plunger 20 when desired, a cylindrical tripping coil 25 is provided. This tripping coil is mounted on a stationary cylindrical bobbin 36 of a suitable non-magnetic material, such as brass or a plastic material. The plunger 20, when released, is free to slide within the bore of the bobbin. When the tripping coil is energized, it develops tripping flux that passes through the interface 29 in a direction opposite to that of the holding flux, thereby reducing the net flux through the interface to a low value that permits spring 6 to release the plunger.

Part of the tripping flux follows the same path as indicated by arrows 30 except in an opposite direction to the arrows. In following this path, this portion of the tripping flux passes through the permanent magnet 22 in a direction opposite to that followed by the holding flux.

Some of the tripping flux, however, instead of passing through the permanent magnet 22 and back wall 12, follows a shunt path through the flux-diverting structure 28 and air gap 32, as indicated by the arrows 40. The presence of the shunt path serves to reduce the reluctance of the overall magnetic circuit for the tripping flux, thus making it possible to develop adequate tripping flux through the interface 29 with reduced input energy into the tripping coil.

The relatively large air gap 32 in the shunt path through flux-diverting structure 28 limits the tripping flux that passes through the shunt path to about 70 percent or less of the total tripping flux, forcing 30 percent or more of such flux through the permanent magnet 22 in a demagnetizing direction. In most trip devices, this relatively large amount of flux through a permanent magnet in a demagnetizing direction would be unacceptable because of its demagnetizing effect on the permanent magnet, but we are able to tolerate such reverse flux without difficulty because of the high resistance of the cobalt-rare earth material to demagnetization. More specifically, our permanent magnet 22 retains substantially all of its original coercive force properties despite the passage therethrough of this large amount of reverse flux.

In some tripping devices, after a permanent magnet has been subjected to such reverse flux, it is necessary to "soak" it with flux in the normal direction from another source in order to restore its original coercive force properties. But this complication is not required in our device because of the above-described high resistance of the cobalt-rare earth material to demagnetization.

Some tripping devices also rely upon saturation of the pole piece to protect the permanent magnet from demagnetization by tripping flux, but this is not required in our device; and, as a matter of fact, our pole piece 24 is designed to operate at flux densities well below the saturation level thereof.

An advantage of having a large air gap 32 in the shunt path through the flux-diverting structure 28 is that during the normal latching period depicted in FIGS. 1 and 2, almost all of the flux from the permanent magnet is available to hold the plunger in its withdrawn position against the pole piece 24. In the illustrated device, only about 5 percent of the holding flux from the permanent magnet passes through the shunt path 28, 32, whereas the remaining 95 percent is available to hold the plunger in its withdrawn position. In accordance with our invention, the air gap 32 is sufficiently large to limit the normal holding flux through the shunt path to less than about 10 percent of the total holding flux, thereby forcing about 90 percent or more of the total holding flux through the interface 29.

Another feature that enables us to efficiently utilize the holding flux developed by the permanent magnet 22 is that the pole piece 24 is shaped to act as a flux concentrator. In this regard, the area of the pole piece at its interface with magnet 22 is approximately 2.1 times its area at the interface 29 with plunger 20. This area relationship enables plunger 20 to be significantly reduced in cross-sectional area, thus significantly reducing its mass and also the frictional opposition that it encounters when sliding in hole 21 during tripping movement. This reduced mass and reduced frictional opposition allow a smaller spring (6) to be used for actuating the plunger during tripping, thus lowering the holding force requirements of the permanent magnet and, hence, the energy required by the tripping coil to effect tripping.

The decreased mass of plunger 20 also results in increased natural frequency of the plunger and, more specifically, a natural frequency above the seismic range of one to 40 cycles per second. This high natural frequency above the seismic range renders the device highly resistant to unintended displacement of the plunger by earthquake-produced vibrations.

It is important that no foreign matter be allowed to find its way into the interface 29 between the plunger 20 and the pole piece 24 because a clearance here, when the plunger is in its withdrawn position, reduces the holding force available from the permanent magnet 22. The illustrated trip device contains a number of features which significantly reduce the chances for entry of such foreign matter. One such feature is a U-shaped cover 41 of non-magnetic material which comprises two imperforate spaced-apart legs 42 and 44 fitting snugly between the side walls 16 and 18 and an imperforate top or bight portion 45 extending between the side walls. Suitable gaskets (not shown) are preferably provided adjacent the interface between the cover and the side walls. The trip arm 3 is mounted on operating shaft 4 in a position outside the space between side walls 16 and 18. Thus, only the rotatable operating shaft extends between the interior and exterior of the trip device. This shaft 4 is supported in suitable bearings 50 that are located in the side walls and are provided with conventional seals 52 that block foreign matter from entering along the shaft. If tripping arm 3 was located between the side walls 16 and 18, it would have to project through the cover 40, and it would be necessary to provide a slot in the cover to accommodate it. It would be much more difficult to seal such a slot than the space around the rotatable shaft 50.

Figure 4:
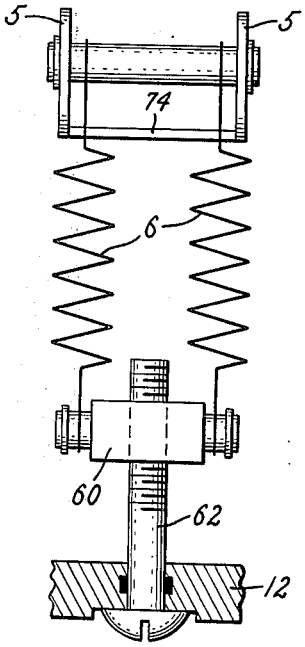
FIG. 4 is an end view of the trip device taken along the line 4—4 of FIG. 1.

Another feature that contributes to improved sealing of the interior of the trip device is the adjusting means provided for adjusting the tension of spring 6. As seen in FIG. 4, spring 6 comprises two separate tension spring elements extending in parallel between lever 5 and a nut 60 near the lower wall 12. These spring elements are coupled to laterally-spaced portions of these parts 5 and 60. Nut 60 is threaded onto a screw 62 that extends vertically through a sealed opening in the lower wall 12. The nut 60 is restrained against rotation on the screw 62 by the two spring elements 60 but is free to shift axially of the screw. Thus, when the screw is rotated, the nut shifts axially thereof to adjust the spring tension. The screw can, of course, be rotated from outside the trip device by use of a suitable screwdriver. The fact that adjustments in spring tension can thus be made from outside the trip device makes it unnecessary to remove the cover 50 to make such adjustments, thus reducing the chances for foreign matter entering the trip device and finding its way into the interface 29.

We utilize the adjusting screws 62 to precisely set the net force on the plunger at a predetermined value when the tripping coil is deenergized. This net force is equal to the magnetic holding force less the spring force. Even though the magnetic holding force may vary slightly due to minor variations in dimensions or materials, it is possible by using the spring adjusting means to develop a precise and predetermined net holding force on the plunger despite such variations. With this net holding force precisely predetermined, the design of the tripping coil 25 can be optimized to provide the required amount of tripping flux.

Figure 3:
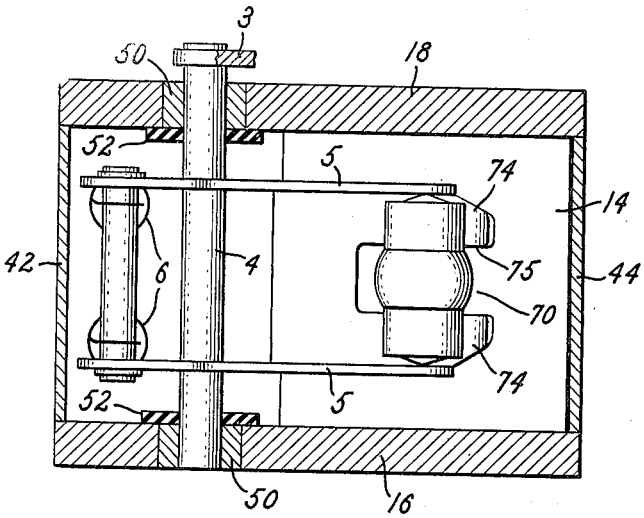
FIG. 3 is a plan view of the trip device taken along the line 3—3 of FIG. 1.

A feature contributing to reduced friction during tripping is the special pivotal joint 70 between operating lever 5 and plunger 20. This is a self-aligning joint that comprises a transverse pivot 72 fixed to the upper end of the plunger. As shown in FIGS. 2 and 3, operating lever 5 comprises two spaced-apart segments and a transverse member 74 extending between the segments and containing an open-ended slot 75 through which the upper end of the plunger 20 freely extends. The transverse pivot 72 rests on the upper surface of the transverse member 74. Because of the slot in the transverse member 74, the operating lever 5 is free to pivot about the axis of shaft 4 without imposing any substantial transverse force on the plunger.

While we have shown and described a particular embodiment of our invention, it will be obvious to those skilled in the art that various changes and modifications may be made without departing from our invention in its broader aspects; and we, therefore, intend in the appended claims to cover all such changes and modifications as fall within the true spirit and scope of our invention.

What we claim as new and desire to secure by Letters Patent of the United States is:

1. In an electromagnetic trip device,

A. a frame of highly permeable magnetic material comprising a back wall, a front wall, and a pair of spaced side walls extending between said front and back walls;

B. a plunger of highly permeable magnetic material supported for straight line reciprocal movement through a close-fitting hole in said front wall;

C. a permanent magnet of cobalt-rare earth material having a pair of opposed poles one of which is located adjacent said back wall;

D. a pole piece of highly permeable magnetic material located between the other pole of said permanent magnet and said plunger and providing a surface against which said plunger is held in a withdrawn position by holding flux from said permanent magnet passing through the interface between said pole piece and said plunger;

E. a tripping coil supported within said frame and surrounding a portion of said plunger for developing, upon energization, tripping flux passing through said interface that opposes the holding flux from said permanent magnet passing through said interface, thereby effecting release of said plunger from its withdrawn position upon energization of said tripping coil;

F. spring means for moving said plunger out of said withdrawn position upon release of said plunger;

G. flux-diverting structure of highly permeable magnetic material located between said tripping coil and said permanent magnet for shunting a portion of said tripping flux through a shunt path that bypasses said permanent magnet and said back wall;

1. said shunt path containing a relatively large non-magnetic gap for limiting the tripping flux through said shunt path sufficiently to cause about 30 percent or more of said tripping flux to pass through said permanent magnet in a direction opposite to the direction of said holding flux, and 2. said non-magnetic gap acting when said coil is de-energized to limit the holding flux passing through said shunt path sufficiently to cause about 90 percent or more of the total holding flux developed by said permanent magnet to pass through said interface, H. a shaft;

I. a tripping member mounted on said shaft;

J. a lever also mounted on said shaft and having two spaced-apart ends, one of which is pivotally connected to said plunger and the other of which is connected to said apring means, and K. means for adjusting the force developed by said spring means while said plunger is held in said withdrawn position.

2. The structure of claim 1 in combination with cover means cooperating with said frame to form a closed housing within which are located said plunger, said permanent magnet, said pole piece, said spring means, said flux-diverting structure, said non-magnetic gap, said rotatable shaft, and said lever; said rotatable shaft projecting outside said housing, and said tripping member being mounted on said shaft in a location outside said housing.

3. The structure of claim 2 in combination with seal means around said shaft where it projects through said housing blocking foreign matter from entering said housing along said shaft.

4. The structure of claim 2 in which said cover means comprises a removable U-shaped cover member having arms that extend between said side walls and a bight-portion interconnecting said arms and also extending between said side walls.

5. The structure of claim 2 in which said adjusting means comprises a member extending through a wall of said housing, said member being rotatable by adjusting force applied outside said housing to adjust said spring means force.

* * * * *